United States Patent [19]

Heynisch

[11] 4,435,672

[45] Mar. 6, 1984

[54] FLAT PICTURE TUBE

[75] Inventor: Hinrich Heynisch, Gräfelfing, Fed. Rep. of Germany

[73] Assignee: Siemens Aktiengesellschaft, Berlin and Munich, Fed. Rep. of Germany

[21] Appl. No.: 358,386

[22] Filed: Mar. 15, 1982

[30] Foreign Application Priority Data

Mar. 27, 1981 [DE] Fed. Rep. of Germany ..... 3112200

[51] Int. Cl.[3] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 3,956,667 | 5/1976 | Veith | 313/217 |
| 4,103,204 | 7/1978 | Credelle | 313/422 |
| 4,103,205 | 7/1978 | Credelle | 313/422 |
| 4,227,117 | 10/1980 | Watanabe et al. | 315/13 R |

FOREIGN PATENT DOCUMENTS

| | | |
|---|---|---|
| 2638308 | 8/1975 | Fed. Rep. of Germany . |
| 2619139 | 11/1977 | Fed. Rep. of Germany . |
| 2412869 | 10/1980 | Fed. Rep. of Germany . |

OTHER PUBLICATIONS

Scott et al., Flat Cathode Ray Tube Display SID Digest 78, Texas Instruments, Dallas, TX.

Smith, CRT Slims Down for Pocket and Projection TVS, Electronics 7-19-1979.

*Primary Examiner*—Theodore M. Blum

*Attorney, Agent, or Firm*—Herbert L. Lerner; Laurence A. Greenberg

[57] ABSTRACT

Flat picture tube, including a front plate and a back plate vacuum-tightly connected to the front plate defining an evacuated envelope, a control matrix of line conductors and column conductors respectively extended in planes parallel to the front plate dividing the evacuated envelope into a forward post acceleration space and a rear electron storage space having electrically conducting rear and side walls, the control matrix of conductors having crossings with electron passage openings formed in the vicinity thereof, at least one thermal cathode in the rear electron storage space having an emission surface, at least one grid-shaped pulling anode each being associated with a respective one of the at least one thermal cathode and each covering the emission surface of the respective at least one thermal cathode at a substantially constant spacing, at least one other anode disposed in the forward post acceleration space, a fluorescent-material layer disposed on the other anode being excitable by electrons and being at a positive potential of several kV relative to the cathode potential in operation of the tube, at least some of the conductors of the control matrix being disposed so as to face the rear electron storage space and being addressed sequentially, information for an addressed line conductor being simultaneously given to all of said column conductors, and in operation of the tube the rear and side walls of the rear electron storage space and unaddressed line conductors being at potentials permitting electrons emitted into the rear electron storage space to pass unaccepted.

12 Claims, 3 Drawing Figures

FLAT PICTURE TUBE

The invention relates to a flat picture tube containing an evacuated envelope with a front plate and a back plate connected vacuum-tightly to the front plate, a control matrix of line conductors and column conductors which extend, respectively, in a plane parallel to the front plate plane (line conductor plane, column conductor plane), divide the interior of the envelope into a rear and a forward space (electron storage space, post-acceleration space) and are provided in the vicinity of their crossings with electron passage openings, at least one thermal cathode as well as at least one grid-shaped pulling anode in the electron storage space and at least one anode contained in the post-acceleration space (post-acceleration anode), which is provided with a fluorescent-material layer, which can be excited by electrons and which, in operation of the tube, is at a positive potential of several kV relative to the cathode potential. Such a picture screen is known from German Published, Non-Prosecuted Application DE-OS 26 19 139.

For years, work has been in progress on the production of a flat picture screen which could replace the classical cathode ray tube. These efforts have only been rewarded up to now by partial successes; in the field of low to medium information displays up to data displays, it has been possible to bring competetive flat displays to the market place. In cases, however, in which larger amounts of information such as video signals must be processed, the cathode tube is uncontested as before.

The development of panels of the gas discharge type is relatively far advanced. Particularly promising appears to be a variant, in which the plasma serves as a large-volume electron source from which electron beams are drawn selectively, are post-accelerated and deflected on a fluorescent-material screen (see in this connection, for instance, German Patent DE-PS 24 12 869 corresponding to U.S. Pat. No. 3,956,667). Today, such a picture screen already yields television pictures with acceptable display qualities; however, it has not yet advanced beyond the laboratory stage, particularly for the reason that the plasma related problems (cathode sputtering, pressure variations, breakdowns in the post-acceleration space) have not yet been solved satisfactorily.

The above-mentioned shortcomings are eliminated if thermal (quasi) planar cathodes are used as an "electron reservoir". Probably the best-known representative of this display type, which is described in SID 78 Digest (1978) 88, has the following construction: The cathode includes a multiplicity of mutually parallel, heated wires each of which is surrounded by a field former electrode. It furnishes a forwardly directed large-area electron stream which is sent into a control structure of several perforated conductor runs placed one behind the other.

When passing this stack of plates, partial currents are continuously blanked out from the electron stream until finally only the desired dot beams remain which then generate bright spots on a phosphorecoated anode which is at a potential of about 18 kV. Such a construction has only a moderate electron yield and requires a multiplicity of apertures for higher picture element densities which must be extremely precisely perforated and aligned with each other; it is therefore not suitable for television purposes.

A single control plane is sufficient if, as provided in the German Published, Non-Prosecuted Application cited above, this plane is provided in the form of a raster of individually addressable plate capacitors, which intercept or pass the entering electrons, depending on the switching state. It is obvious that such a capacitor matrix still raises considerable technological problems and utilizes, as before, only a small part of the generated electrons.

The electron losses remain relatively small if a point or band-shaped electron beam is shot in from the side and this beam is deflected forward onto a phosphor. With this concept, although intriguing at first glance, the beam management presents considerable difficulties in practice. Thus, relatively simple focusing is only possible with picture distortion that is still tolerable for the very smallest picture formats (see, for example, the publication "Electronics" of July 19, 1979, Page 67 and following); for larger display fields, one must fall back on highly complicated longitudinal filigree systems (German Published, Non-Presecuted Application DE-OS 26 38 308 corresponding to U.S. Pat. Nos. 4,103,204 and 4,103,205).

It is accordingly an object of the invention to provide a plasma-less flat electron beam tube which overcomes the hereinafore-mentioned disadvantages of the heretofore-known devices of this general type, which has high efficiency, is of relatively simple construction and can particularly even display (color) television pictures of good quality in any desired format.

With the foregoing and other objects in view there is provided, in accordance with the invention, a flat picture tube, comprising a front plate and a back plate vacuum-tightly connected to the front plate defining an evacuated envelope, a control matrix of line conductors and column conductors respectively extended in planes parallel to the plane of the front plate dividing the interior of the evacuated envelope into a forward post acceleration space and a rear electron storage space having electrically conducting rear and side walls, the control matrix of conductors having crossings with electron passage openings formed in the vicinity thereof, at least one thermal cathode in the rear electron storage space having an emission surface, at least one grid-shaped pulling anode each being associated with a respective one of the at least one thermal cathode and each covering the emission surface of the respective at least one thermal cathode at a substantially or at least approximately constant spacing, at least one other anode disposed in the forward post acceleration space, a fluorescent-material layer disposed on the other anode being excitable by electrons and being at a positive potential of several kV relative to the cathode potention in operation of the tube, at least some of the conductors of the control matrix being disposed so as to face the rear electron storage space and being addressed sequentially, information for a just addressed line conductor being simultaneously given to all of the column conductors, and in operation of the tube the rear and side walls of the rear electron storage space and unaddressed line conductors being at potentials preventing electrons emitted into the rear electron storage space from reaching or passing said electrodes.

In accordance with another feature of the invention, the at least one thermal cathode is strip-shaped and is disposed in one of the side walls of the rear electron storage space.

In accordance with a further feature of the invention, the at least one thermal cathode is in the shape of a cylindrical rod extended parallel to the line conductors in the interior of the rear electron storage space and is coaxially surrounded by the respective pulling anode.

In accordance with an added feature of the invention, the rear wall of the rear electron storage space is disposed at a set distance from the control matrix and the at least one thermal cathode is in the form of a plurality of adjacent mutually equidistant rod cathodes including two outer rod cathodes disposed at a given distance from the side walls of the rear electron storage space adjacent thereto, the given distance being substantially half as large as the distance between the adjacent rod cathode and substantially equal to the set distance.

In accordance with an additional feature of the invention, the conductors of the control matrix are in the form of wires.

In accordance with again another feature of the invention, always only one pulling anode is at positive potential in operation of the tube.

In the proposed picture screen, the electrons entering the electron storage space are relatively slow; their kinetic energy comes substantially from the difference between the cathode and the pulling anode potential which normally has values between 1 V and 2 V; to this amount is still added a thermal component which is relatively small for most of the electrons and, for a cathode temperature of 1000° K., is about 1/10 eV on the average. These electrons therefore have time to spread in the "electron storage space" and to distribute themselves uniformly, before they are suctioned off by an addressed line. During their dwelling time in storage, they can neither flow to the walls nor to the unaddressed lines, because all these parts are normally at a potential which is relatively weakly negative relative to the pulling anode potential. This means that the cathodes basically need to replenish only the electrons in the amount which is taken from the electron storage by a single cell. A rough estimate shows that, without difficulty, electron streams can be brought to one line in which a post-acceleration voltage of a few kV (guidepost value: 3 kV) leads to bright pictures. With these modest potential differences there are no aggravating high voltage problems; in particular no point discharges need be expected, so that under normal conditions no additional shielding electrodes are necessary in the post-acceleration space.

As a further advantage is added that the "electron gas" can be "encarcertated" with extremely small voltage differences and deflected cleanly onto the respectively addressed line. The focusing errors are so small that there is no interfering brightening of the background, cross talk effects or beam spreading. In addition, the electron stream per line can be varied within wide limits by a small variation of the pulling anode voltage. For a flat cathode, as is well known, the relation $I \sim (F/d^2) \times U^{3/2}$ (F=cathode area, d=distance between cathode and pulling anode) applies for the relation between the cathode current I and the pulling anode voltage U.

Otherwise, a tube according to the invention is distinguished by a construction which requires no bulky, heavy parts in the vacuum space and can be manufactured without special effort. For practically every detail, such as the electron generating system, one can fall back to proven technologies from the field of high-vacuum tubes.

Normally, the electron cloud in the electron storage space has so homogeneous a density distribution that the brightness variations on the picture screen are kept within acceptable limits. Under certain conditions, however, for instance in a very flat electron storage space, it may happen that the lines away from the cathodes are supplied distinctly more poorly with electrons than the lines close to the cathodes. For these cases, simple compensation measures are available. Therefore, in accordance with again a further feature of the invention, there are provided line drive means synchronizing the potential of the at least one pulling anode, in operation of the tube, for increasing applied pulling anode voltage with increased distance of the just addressed line conductors or line conductor groups from the at least one pulling anode. In accordance with again an added feature of the invention, the rear wall of the rear electron storage space is subdivided into a plurality of strips being electrically insulated from each other, extended parallel to the line conductors and at different potentials in operation of the tube, for guiding electrons emitted into the rear electron storage space into the vicinity of the side walls of the rear electron storage space by electrostatic periodic focusing. In accordance with again an additional feature of the invention, in operation of the tube, the potentials of the rear wall strips are synchronized with the line drive means for leading electrons emitted into the rear electron storage space into vicinity of the just addressed line conductor, amplified by electrostatic periodic focusing.

If fringe disturbances which start out from the side walls of the storage space are noticeable, one could simply make the number and/or the length of the line conductors somewhat larger than is necessary for the construction of the picture.

In accordance with yet another feature of the invention, there are provided strip conductors lying in a plane parallel to the plane of the control matrix and being aligned with the line conductors of the control matrix in the forward post acceleration space, and a continuous planar electrode extended parallel to the plane of the control matrix between the strip conductors and the other anode in the post acceleration space, the strip conductors and the planar electrode having electron passage openings formed therein being aligned with respective electron passage openings formed in the control matrix.

In accordance with yet a further feature of the invention, in operation of the tube, for a cathode potential of OV, the at least one pulling anode is switched on at potential of between +1 V and +2 V, the rear and side walls of the rear electron storage space have a potential of between OV and −2 V, the unaddressed line conductors are at a potential of between −1 V and −2 V and the just addressed line conductor being lifted to a positive potential of between 10 and 100 V.

In accordance with a concomitant feature of the invention, the tube reproduces a television picture of at most 14 or preferably 12 cm measured diagonally.

Other features which are considered as characteristic for the invention are set forth in the appended claims.

Although the invention is illustrated and described herein as embodied in a flat picture tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

For the sake of clarity, the figures are highly diagrammatic. Thus, display parts such as leads, seals and feedthroughs which are not absolutely necessary for an understanding of the invention, are often omitted.

Figure 1:
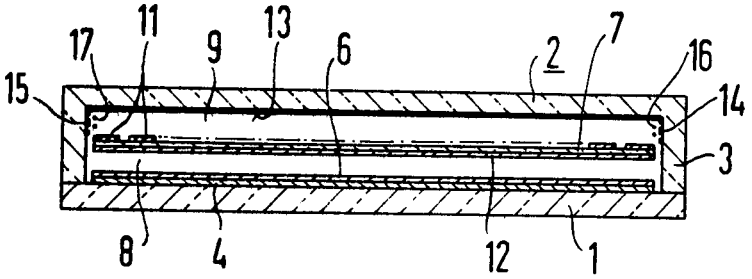
FIG. 1 is a diagrammatic lateral cross-sectional view taken through a first embodiment example of the invention.

Referring now to the figures of the drawing in which corresponding parts are provided with the same reference symbols, and first particularly to FIG. 1 thereof, it is seen that the picture screen contains a vacuum envelope with a planar front plate 1 and a back plate 2 which is connected by being hermetically sealed to the front plate through a formed-on or integral lateral rib 3. The front plate is coated on its inner surface with an electrode (post-acceleration anode) 4 which in turn carries a fluorescent material layer 6. The interior of the vacuum envelope is divided by a support plate 7 into a forward space (post-acceleration space) 8 and a back space (electron storage space) 9. On both of its sides, the support plate 7 is provided with a family of mutually parallel conductors (line conductors 11 and column conductors 12). The conductor matrix as well as the support plate are provided with non-illustrated electron passage openings at the crossings of the conductors. The back plate 2 is coated with an electrically conducting coating 13 where it forms the boundary of the electron storage space 9. This coating has a recess at the four narrow sides of the electron storage space and specifically in a central location, into which a cathode 14, 15 with a planar emission surface is embedded. In front of each cathode 14, 15 there is disposed a grid-like pulling anode 16, 17, respectively, which extends in a plane parallel to the emission surface.

The display is operated with the following voltages: With a cathode potential of 0 volts, the pulling anodes are at +1 V to +2 V, the electrically conducting back and side walls of the electron storage space 9 at 0 V to −2 V; the addressed line at +20 V to +50 V and the other lines at −2 V.

The following materials were used for the display parts:

Glass for the front, back and support plate, wherein the back plate was given its tray-like profile by a pressing operation; tin oxide for the post-accelerating anode; Ti, Pt, Vacovit for the consuctors of the control matrix; Ni (oxide cathode) for the cathode, for instance, and Cu, Mo etc. for the pulling anode. The fluorescent material is formed of commercially available phosphors which form a strip or dot pattern from the colors red, green and blue in a manner which is known, for a color presentation.

Figure 2:
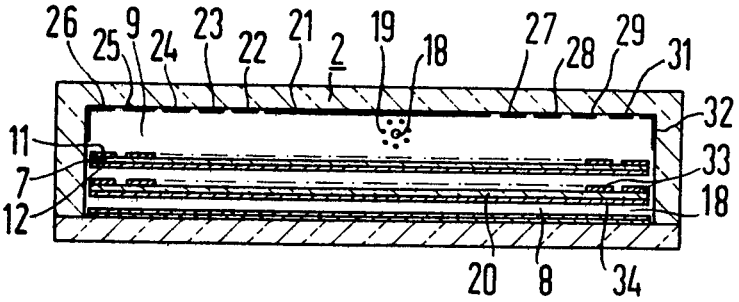
FIG. 2 is a view similar to FIG. 1 of a second embodiment example.

The display embodiment shown in FIG. 2 differs from the construction of FIG. 1 particularly with respect to three details: The four laterally disposed electron generators are replaced by a generating system with a rod cathode 18 and a hollow-cylindrical pulling anode 19; in the post-acceleration space there is a further electrode plate 20; and the electrically conducting back wall of the electron storage space is divided into several mutually parallel strips 21, 22, 23, 24, 25, 26, 27, 28, 29, 31, 32.

The rod cathode 18 is placed approximately in the middle of the electron storage space, extended parallel to the line conductors 11 and protruding slightly thereover at both ends. The rod cathode 18 is formed of a directly heated nickel tube, which can be quickly brought to the required operating temperatures, and has a diameter of about 1 mm. The cross section of the pulling anode 19 surrounding the rod cathode should be about 2 mm. The cathode could also be constructed as a wire, helix or double helix, but for reasons of mechanical strength, a tubular cathode is preferred.

The plate 20 carries strip conductors 33 on its side facing the control matrix. The strip conductors 33 are aligned with the line conductors of the control matrix. On its side facing the post-acceleration anode, the plate 20 also carries a continuous planar electrode 34. The entire unit is perforated at the same points as the support plate. The strip conductors 33 are at a potential of about 10 . . . 100 V in the operation of the tube; and the planar electrode 34 is at 100 . . . 300 V. Such a pentode structure permits substantial post-acceleration voltages and is recommended if it is desired to operate with a small total emission area and/or a very bright presentation.

Figure 3:
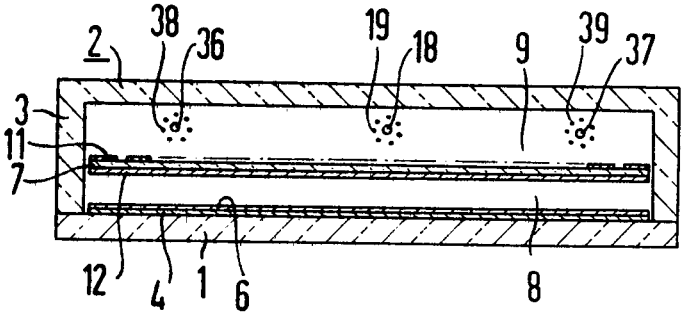
FIG. 3 is another view similar to FIGS. 1 and 2 of a further embodiment example.

The strips in the back wall, which extend parallel to the line conductors like the rod cathode, are at alternating higher and lower potentials, in order to transport part of the electrons emitted by the central cathode by a kind of electrostatic periodic focusing to the edge regions of the electron storage space. The strip potential and geometry are matched to the electron velocity in such a manner that even the lines near the edge receive a similarly intense electron stream as compared to the lines in the immediate vicinity of the cathode. If required, the strip potential could also be synchronized with the line scan, such as by line or line group-wise switching. Uniform illumination of the display field can also be achieved by the provision of the pulling-anode voltage being switched and/or several cathodes being distributed in the electron storage space, as shown in FIG. 3. When making the pulling-anode voltage follow, attention will be paid to the fact that if lines or line groups away from the cathode are addressed, a higher voltage must be applied then with addressing line or line groups closer to the cathode. If several cathodes are contained in the storage space, it will be sufficient to apply positive potential only to that pulling anode, having the cathode being closest to the line just being addressed; this is because the other cathodes supply distinctly smaller electron contributions for this line.

The display modification of FIG. 3 deviates from the example shown in FIG. 2 in three details: The electron generating system contains three rod cathodes 18, 36, 37 and three pulling anodes 19, 38, 39; the electrode plate 20 as well as the support plate 7 are omitted, and the matrix conductors are in the form of wires. The cathodes 18 have a spacing from each other which is about twice as large as the distance between the back wall 2 of the storage space and the line conductors 11. This distance corresponds approximately to the distance at which the outer cathodes are kept from the side walls of the storage space adjacent thereto.

A construction with a wire grid-like control matrix offers special advantages for small-format picture screens, such as a television set with a diagonal measurement of a picture of 12 cm to 14 cm, for instance, or a miniature data display screen in minicomputers. Each picture element is composed of four sub-dots which are distinctly separated from each other by the wire crossing, so that an observer cannot resolve or distinguish the dot raster even from a very short distance. In addition, no problems are presented in the manufacture of the control grid, the lines and columns of which can be wound as a parallel wire grid on frames and must have a pitch in the order of magnitude of 100 μm.

The invention is not limited to the embodiment examples shown. Thus, there still remains a considerable latitude for construction particularly with respect to mechanical construction, because the essential point is merely that in an "electron box", slow electrons are generated, distributed and kept without losses, and that from this electron source, electrons are drawn, accelerated and brought line-sequentially to a phospor by a control matrix.

I claim:

1. Flat picture tube, comprising a front plate and a back plate vacuum-tightly connected to said front plate defining an evacuated envelope, a control matrix of line conductors and column conductors respectively extended in planes parallel to said front plate dividing the evacuated envelope into a forward post acceleration space and a rear electron storage space having electrically conducting rear and side walls, said control matrix of conductors having crossings with electron passage openings formed in the vicinity thereof, at least one thermal cathode in said rear electron storage space having an emission surface, at least one grid-shaped pulling anode each being associated with a respective one of said at least one thermal cathode and each covering said emission surface of said respective at least one thermal cathode at a substantially constant spacing, at least one other anode disposed in said forward post acceleration space, a fluorescent-material layer disposed on said other anode being excitable by electrons and being at a positive potential of several kV relative to the cathode potential in operation of the tube, at least some of said conductors of said control matrix being disposed so as to face said rear electron storage space and being addressed sequentially, information for an addressed line conductor being simultaneously given to all of said column conductors, and in operation of the tube said rear and side walls of said rear electron storage space and unaddressed line conductors being at potentials preventing electrons emitted into said rear electron storage space from reaching or passing said read and side walls and unaddressed line conductors.

2. Tube according to claim 1, wherein said at least one thermal cathode is strip-shaped and is disposed in one of said side walls of said rear electron storage space.

3. Tube according to claim 1, wherein said at least one thermal cathode is in the shape of a cylindrical rod extended parallel to said line conductors in said rear electron storage space and is coaxially surrounded by said respective pulling anode.

4. Tube according to claim 3, wherein said rear wall of said rear electron storage space is disposed at a set distance from said control matrix and said at least one thermal cathode is in the form of a plurality of adjacent mutually equidistant rod cathodes including two outer rod cathodes disposed at a given distance from said side walls of said rear electron storage space adjacent thereto, said given distance being substantially half as large as the distance between said adjacent rod cathodes and substantially equal to said set distance.

5. Tube according to claim 1, wherein said conductors of said control matrix are in the form of wires.

6. Tube according to claim 1 or 4, wherein only one pulling anode is at positive potential in operation of the tube.

7. Tube according to claim 1, including line drive means synchronizing the potential of said at least one pulling anode, in operation of the tube, for applying an increased pulling anode voltage in proportion to the distance between said addressed line conductors and said at least one pulling anode.

8. Tube according to claim 7, wherein said rear wall of said rear electron storage space is subdivided into a plurality of strips being electrically insulated from each other, extended parallel to said line conductors and alternating at higher and power potentials in operation of the tube, for guiding electrons emitted into said rear electron storage space into the vicinity of said side walls of said rear electron storage space by electrostatic periodic focusing.

9. Tube according to claim 1, including strip conductors lying in a plane parallel to the plane of said control matrix and being aligned with said line conductors of said control matrix in said forward post acceleration space, and a continuous planar electrode extended parallel to the plane of said control matrix between said strip conductors and said other anode in said post acceleration space, said strip conductors and said planar electrode having electron passage openings formed therein being aligned with respective electron passage openings formed in said control matrix.

10. Tube according to claim 1, wherein, in operation of the tube, for a cathode potential of OV, said at least one pulling anode is switched on at a potential of between +1 V and +2 V, said rear and side walls of said rear electron storage space have a potential of between OV and −2 V, said unaddressed line conductors are at a potential of between −1 V and −2 V and said addressed line conductor being lifted to a positive potential of between 10 and 100 V.

11. Tube according to claim 1 or 5, wherein the tube reproduces a television picture of at most 14 cm measured diagonally.

12. Tube according to claim 1 or 5, wherein the tube reproduces a television picture of at most 12 cm measured diagonally.

* * * * *